US011927073B2

(12) United States Patent
Elfar

(10) Patent No.: US 11,927,073 B2
(45) Date of Patent: Mar. 12, 2024

(54) DOWNHOLE PULSATION VALVE SYSTEM AND METHOD

(71) Applicant: Talal Elfar, Calgary (CA)

(72) Inventor: Talal Elfar, Calgary (CA)

( * ) Notice: Subject to any disclaimer, the term of this patent is extended or adjusted under 35 U.S.C. 154(b) by 280 days.

(21) Appl. No.: 17/343,507

(22) Filed: Jun. 9, 2021

(65) Prior Publication Data

US 2022/0397017 A1 Dec. 15, 2022

(51) Int. Cl.

| | |
|---|---|
| ***E21B 34/10*** | (2006.01) |
| ***E21B 31/00*** | (2006.01) |
| ***E21B 34/14*** | (2006.01) |

(52) U.S. Cl.

CPC ..... *E21B 34/10* (2013.01); *E21B 31/005* (2013.01); *E21B 34/14* (2013.01)

(58) Field of Classification Search

CPC ..... E21B 7/24; E21B 21/10

See application file for complete search history.

(56) References Cited

U.S. PATENT DOCUMENTS

| | | | |
|---|---|---|---|
| 8,181,719 | B2 | 5/2012 | Bunney et al. |
| 8,469,104 | B2 | 6/2013 | Downton |
| 9,004,194 | B2 | 4/2015 | Eddison et al. |
| 9,194,208 | B2 | 11/2015 | Schultz et al. |
| 9,273,529 | B2 | 3/2016 | Eddison et al. |
| 9,598,923 | B2 | 3/2017 | Gilleylen et al. |
| 9,637,976 | B2 | 5/2017 | Lorenson et al. |
| 9,702,192 | B2 | 7/2017 | Wicks et al. |
| 9,765,584 | B2 | 9/2017 | Lorenson et al. |
| 9,840,872 | B2 | 12/2017 | Schultz et al. |
| 9,840,873 | B2 | 12/2017 | Schultz et al. |
| 9,903,161 | B2 | 2/2018 | Schultz et al. |
| 9,915,183 | B2 | 3/2018 | Sealy et al. |
| 9,963,937 | B2 | 5/2018 | Prill et al. |
| 10,648,239 | B2 | 5/2020 | Elfar |
| 10,865,612 | B2 | 12/2020 | Elfar |
| 2007/0187112 | A1 | 8/2007 | Eddison et al. |
| 2010/0326733 | A1 | 12/2010 | Anderson |
| 2011/0036560 | A1 | 2/2011 | Vail, III et al. |
| 2016/0194917 | A1 | 7/2016 | Alali et al. |

(Continued)

FOREIGN PATENT DOCUMENTS

| | | | |
|---|---|---|---|
| CA | 2861839 | A1 | 7/2013 |
| CA | 2836182 | A1 | 6/2014 |

(Continued)

*Primary Examiner* — Dany E Akakpo
(74) *Attorney, Agent, or Firm* — David Guerra

(57) ABSTRACT

A pulsation valve system and method can include a mandrel, an oscillating valve head and a stationary valve head. The mandrel can be operably coupled to a rotor of a pulsation assembly, and can include bypass bores controlled by a spring biased piston that moves in response to a predetermined fluid pressure acting thereon. The oscillating valve head can be attached to and rotatable with the mandrel. The stationary valve head can be positioned adjacent and stationary with respect to the oscillating valve head. The stationary valve head can include a stationary valve bore defined therethrough. The oscillating valve head can include an oscillating valve bore defined therethrough that is alignable with the stationary valve bore at a predetermined rotational position. The stationary valve bore can have a radial length greater than the oscillating valve bore.

16 Claims, 8 Drawing Sheets

(56) References Cited

U.S. PATENT DOCUMENTS

| | | | | |
|---|---|---|---|---|
| 2017/0191325 | A1 | 7/2017 | Campbell | |
| 2017/0254182 | A1 | 9/2017 | Gregory et al. | |
| 2018/0038182 | A1 | 2/2018 | Schultz et al. | |
| 2021/0277743 | A1 | 9/2021 | Schultz et al. | |
| 2022/0282588 | A1* | 9/2022 | Trinh | E21B 21/10 |

FOREIGN PATENT DOCUMENTS

| | | | |
|---|---|---|---|
| CA | 2892254 | A1 | 7/2014 |
| CA | 2922999 | A1 | 5/2015 |
| CA | 2872736 | C | 12/2015 |
| CA | 2960699 | A1 | 3/2016 |
| CA | 2780236 | C | 7/2016 |
| CA | 2680895 | C | 5/2017 |
| CA | 2892971 | C | 9/2017 |
| CA | 2985258 | A1 | 5/2018 |
| CA | 2798807 | C | 9/2020 |
| CA | 3036840 | C | 4/2021 |
| CA | 3049345 | C | 7/2021 |
| WO | 2017197442 | A1 | 11/2017 |

* cited by examiner

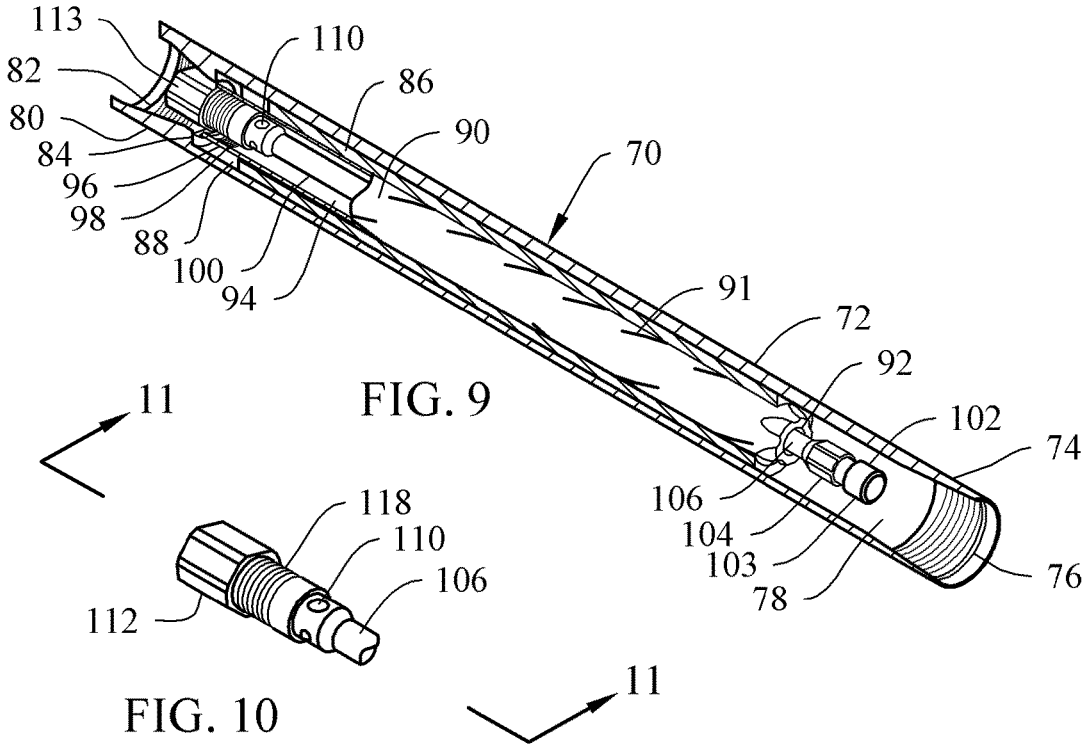
FIG. 9
FIG. 10
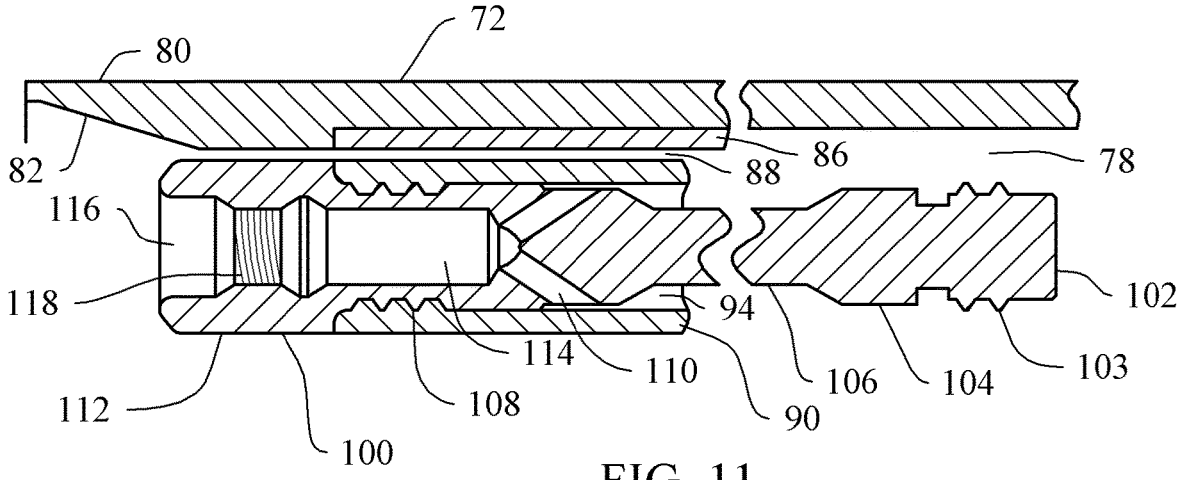
FIG. 11

DOWNHOLE PULSATION VALVE SYSTEM AND METHOD

BACKGROUND

Technical Field

The present technology relates to a downhole pulsation valve system and method for use in connection with providing oscillating fluid flow to a pulsation and/or agitation device for reducing friction acting on a tool string and/or advancing the tool string.

Background Description

Conventional oil and gas drilling involves the rotation of a drill string at the surface which rotates a drill bit mounted to the bottom of the drill string. It is known that to access sub-surface hydrocarbon formations by drilling long bore holes into the earth from the surface. Conventional systems includes advancing a drill bit along the hole, with the drill bit being mounted at the end of a bottom hole assembly (BHA).

During the advancing of the drill bit, friction between the BHA and the well sides can impair the advancing of the drill bit, and in some cases the BHA can get stuck in the well. This is more the case when drilling angled or horizontal holes. In some circumstances, the weight of the drill string is not sufficient to overcome the friction.

In other drilling operations, a motor may be used to rotate the drill bit. Coiled or flexible tubing can be utilized in many downhole operations, but due to its inherent transverse flexibility, coiled tubing in generally more susceptible to buckling than rigid strings consisting of threadably connected tubulars. One solution to this known disadvantage in coiled tubing is to use extended reach tools in conduction with coiled tubing.

Situations occur where it is more difficult to advance the drill bit in a hydrocarbon formation. These situations can occur during horizontal drilling operations wherein additional loads are placed on the coiled tubing. It is common during some operations that friction lock-up occurs and the entire drill string can get stuck in the well.

The use of cavitation devices are known, such as casing reamer shoes, multi-part stators and counter-weighted devices, to create a pulsation or vibration at the BHA to assist in advancement through the earth or to free the BHA. These known cavitation or vibration devices are not capable of providing controlled, tunable pressure pulses, using a stator rotor configuration. Some of these known cavitation or vibration devices are further not capable of being utilized with coiled tubing.

Rotational in combination with stationary valve flow heads may be known in the industry, however, these known valve systems are limited in their operational capacity. They further may have disadvantages of separation between the rotating and stationary valve members due to increase pressure applied between their adjacent surfaces. This can cause the rotating and stationary valve members to separate and allow fluid to freely flow past the valve. A further disadvantage of these known valve can be the direct on and off flow of the fluid, thereby creating increased pressure pulses that can damage the valve and/or tools downstream thereof.

While the above-described devices fulfill their respective, particular objectives and requirements, the aforementioned devices or systems do not describe a downhole pulsation valve system and method that allows providing oscillating fluid flow to a pulsation and/or agitation device for reducing friction acting on a tool string and/or advancing the tool string.

A need exists for a new and novel downhole pulsation valve system and method that can be used for providing oscillating fluid flow to a pulsation and/or agitation device for reducing friction acting on a tool string and/or advancing the tool string. In this regard, the present technology substantially fulfills this need. In this respect, the downhole pulsation valve system and method according to the present technology substantially departs from the conventional concepts and designs of the prior art, and in doing so provides an apparatus primarily developed for the purpose of providing oscillating fluid flow to a pulsation and/or agitation device for reducing friction acting on a tool string and/or advancing the tool string.

SUMMARY

In view of the foregoing disadvantages inherent in the known types of valve system now present in the prior art, the present technology provides a novel downhole pulsation valve system and method, and overcomes one or more of the mentioned disadvantages and drawbacks of the prior art. As such, the general purpose of the present technology, which will be described subsequently in greater detail, is to provide a new and novel downhole pulsation valve system and method and method which has all the advantages of the prior art mentioned heretofore and many novel features that result in a downhole pulsation valve system and method which is not anticipated, rendered obvious, suggested, or even implied by the prior art, either alone or in any combination thereof.

According to one aspect, the present technology can include a pulsation valve system including a mandrel, an oscillating valve head and a stationary valve head. The mandrel can be operably coupled to a rotor of a pulsation assembly. The oscillating valve head can be attachable to the mandrel and rotatable with the mandrel. The oscillating valve head can include an oscillating valve bore defined therethrough and parallel with a longitudinal axis of the oscillating valve head. The stationary valve head can be positioned adjacent and stationary with respect to the oscillating valve head. The stationary valve head can include a stationary valve bore defined therethrough and parallel with a longitudinal axis of the stationary valve head. The oscillating valve bore can be alignable with the stationary valve bore at a predetermined rotational position.

According to another aspect, the present technology can include a pulsation valve including a mandrel, an oscillating valve head and a stationary valve head. The mandrel can be operably coupled to a rotor of a pulsation assembly. The oscillating valve head can be attachable to the mandrel and rotatable with the mandrel. The oscillating valve head can include an oscillating valve bore defined therethrough and parallel with a longitudinal axis of the oscillating valve head. The stationary valve head can be positioned adjacent and stationary with respect to the oscillating valve head. The stationary valve head can include a stationary valve bore defined therethrough and parallel with a longitudinal axis of the stationary valve head. The stationary valve bore can have a radial length greater than a width of the oscillating valve bore. The oscillating valve bore can be alignable with the stationary valve bore at a predetermined rotational position.

According to still another aspect, the present technology can include a pulsation valve system including a mandrel, an oscillating valve head and a stationary valve head. The mandrel can be operably coupled to a rotor of a pulsation assembly. The mandrel can include a mandrel bore defined through a first mandrel end and along a longitudinal axis of the mandrel. The mandrel can further include bypass bores defined at an angle through the mandrel and in communication with the mandrel bore. A spring can be locatable in the mandrel bore, and a piston can be slidably receivable in the mandrel bore in operable contact with the spring. The piston can be configured to block an entrance of the bypass bores from inside the mandrel bore at a first position and to allow fluid to flow into the bypass bores from inside the mandrel bore at a second position. The oscillating valve head can be attachable to the mandrel and rotatable with the mandrel. The oscillating valve head can include an oscillating valve bore defined therethrough and parallel with a longitudinal axis of the oscillating valve head. The stationary valve head can be positioned adjacent and stationary with respect to the oscillating valve head. The stationary valve head can include a stationary valve bore defined therethrough and parallel with a longitudinal axis of the stationary valve head. The oscillating valve bore can be alignable with the stationary valve bore at a predetermined rotational position. The spring can be configured to allow the piston to move to the second position when a predetermined fluid pressure is provided on the piston from the mandrel bore received from the first oscillating valve central bore.

According to yet another aspect, the present technology can include a method of using a pulsation valve system for oscillating fluid flow to a pulsation assembly. The method can include the steps of flowing a working fluid to an oscillating valve head that is attachable to a mandrel operably coupled to a rotor of the pulsation assembly, and then to the rotor of the pulsation assembly to impart rotation of the mandrel and the oscillating valve head with respect to a stationary valve head positioned adjacent and stationary with respect to the oscillating valve head. Then rotating the oscillating valve head so that an oscillating valve bore defined through the oscillating valve head comes in and out of alignment with a stationary valve bore defined through the stationary valve head. Controlling a flow of the working fluid entering the pulsation assembly dependent on a rotational location of the oscillating valve bore in relation to the stationary valve bore.

According to still yet another aspect, the present technology can include a pulsation valve system including a mandrel, an oscillating valve head and a stationary valve head. The mandrel can be operably coupled to a rotor of a pulsation assembly. The mandrel can include a mandrel bore defined through a first mandrel end and along a longitudinal axis of the mandrel. The mandrel can further include bypass bores defined at an angle through the mandrel and in communication with the mandrel bore. A spring can be locatable in the mandrel bore, and a piston can be slidably receivable in the mandrel bore in operable contact with the spring. The piston can be configured to block an entrance of the bypass bores from inside the mandrel bore at a first position and to allow fluid to flow into the bypass bores from inside the mandrel bore at a second position. The oscillating valve head can be attachable to the mandrel and rotatable with the mandrel. The oscillating valve head can include an oscillating valve bore defined therethrough and parallel with a longitudinal axis of the oscillating valve head. The stationary valve head can be positioned adjacent and stationary with respect to the oscillating valve head. The stationary valve head can include a stationary valve bore defined therethrough and parallel with a longitudinal axis of the stationary valve head. The stationary valve bore can have a radial length greater than a width of the oscillating valve bore. The oscillating valve bore can be alignable with the stationary valve bore at a predetermined rotational position. The mandrel bore can be in communication with a first oscillating valve central bore of the oscillating valve head. The spring can be configured to allow the piston to move to the second position when a predetermined fluid pressure is provided on the piston from the mandrel bore received from the first oscillating valve central bore.

In some or all embodiments, an amount of fluid entering the stationary valve bore can be dependent on a rotational location of the oscillating valve bore in relation with the stationary valve bore.

In some or all embodiments, the stationary valve bore can have a size greater than the oscillating valve bore.

In some or all embodiments, the stationary valve bore can have a radial length greater than a width of oscillating valve bore.

In some or all embodiments, the stationary valve bore can be offset from a stationary valve central bore defined through the stationary valve head. The stationary valve bore is not in communication with the stationary valve central bore.

In some or all embodiments, the stationary valve head can be fixedly secured in a first end bore of a valve assembly housing. The first end bore of the valve assembly housing can be configured to rotatably received the oscillating valve head and at least a portion of the mandrel.

Some or all embodiments of the present technology can include a bushing located in a stationary valve central bore. The bushing can be configured to rotatably and axially receive a valve end section of the mandrel.

In some or all embodiments, the valve end section of the mandrel can be receivable and secured in a second oscillating valve central bore defined in the oscillating valve head. The second oscillating valve central bore can have a size greater than a first oscillating valve central bore defined in the oscillating valve head and is in communication therewith.

In some or all embodiments, the oscillating valve head can include channels radially defined in an oscillating valve face of the oscillating valve head adjacent to a stationary valve face of the stationary valve head. The channels can be configured to allow fluid to travel between the stationary valve head and the oscillating valve head to an open area between an internal area of the bushing and an external surface of the valve end section.

In some or all embodiments, the mandrel can include a mandrel bore defined through a first mandrel end and along a longitudinal axis of the mandrel. The mandrel can further include bypass bores defined at an angle through the mandrel and in communication with the mandrel bore. The mandrel bore can be in communication with a first oscillating valve central bore of the oscillating valve head.

Some or all embodiments of the present technology can include a spring located in the mandrel bore.

Some or all embodiments of the present technology can include a piston slidably received in the mandrel bore in operable contact with the spring. The piston can be configured to block an entrance of the bypass bores from inside the mandrel bore at a first position and to allow fluid to flow into the bypass bores from inside the mandrel bore at a second position.

In some or all embodiments, the spring can be configured to allow the piston to move to the second position when a predetermined fluid pressure is provided on the piston from the mandrel bore received from the first oscillating valve central bore.

Some or all embodiments of the present technology can include a flexshaft connected to a second end of the mandrel. The flexshaft can be operably connecting to the rotor of the pulsation assembly.

There has thus been outlined, rather broadly, features of the present technology in order that the detailed description thereof that follows may be better understood and in order that the present contribution to the art may be better appreciated.

Numerous objects, features and advantages of the present technology will be readily apparent to those of ordinary skill in the art upon a reading of the following detailed description of the present technology, but nonetheless illustrative, embodiments of the present technology when taken in conjunction with the accompanying drawings.

As such, those skilled in the art will appreciate that the conception, upon which this disclosure is based, may readily be utilized as a basis for the designing of other structures, methods and systems for carrying out the several purposes of the present technology. It is, therefore, that the claims be regarded as including such equivalent constructions insofar as they do not depart from the spirit and scope of the present technology.

It is another object of the present technology to provide a new and novel downhole pulsation valve system and method that may be easily and efficiently manufactured and marketed.

An even further object of the present technology is to provide a new and novel downhole pulsation valve system and method that has a low cost of manufacture with regard to both materials and labor, and which accordingly is then susceptible of low prices of sale to the consuming public, thereby making such downhole pulsation valve system and method economically available to the buying public.

These together with other objects of the present technology, along with the various features of novelty that characterize the present technology, are pointed out with particularity in the claims annexed to and forming a part of this disclosure. For a better understanding of the present technology, its operating advantages and the specific objects attained by its uses, reference should be made to the accompanying drawings and descriptive matter in which there are illustrated embodiments of the present technology. Whilst multiple objects of the present technology have been identified herein, it will be understood that the claimed present technology is not limited to meeting most or all of the objects identified and that some embodiments of the present technology may meet only one such object or none at all.

BRIEF DESCRIPTION OF THE DRAWINGS

The present technology will be better understood and objects other than those set forth above will become apparent when consideration is given to the following detailed description thereof. Such description makes reference to the annexed drawings wherein:

FIG. 9 is a cross-sectional perspective view of the stator and rotor assembly of the present technology.

FIG. 10 is an enlarged perspective view of the second end of the flexshaft of the present technology.

FIG. 11 is a cross-sectional view of the second end of the flexshaft taken along line 11-11 in FIG. 10.

The same reference numerals refer to the same parts throughout the various figures.

DETAILED DESCRIPTION OF THE EMBODIMENTS

Figure 1:
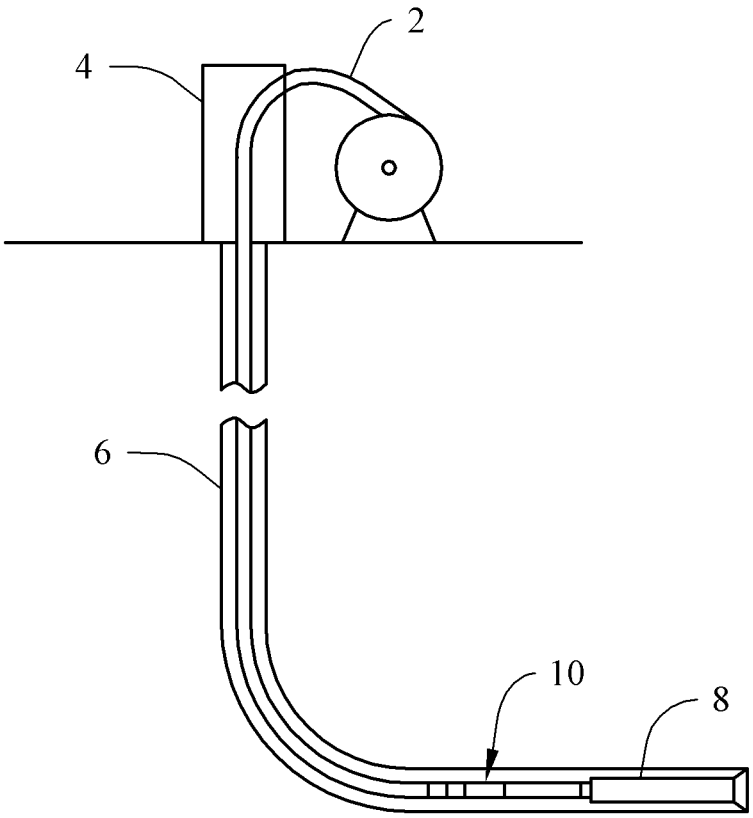
FIG. 1 illustrates a well site system utilizing an embodiment of the downhole pulsation valve system and method constructed in accordance with the principles of the present technology.

In the following description, for purposes of explanation and not limitation, specific details are set forth, such as particular embodiments, procedures, techniques, etc. in order to provide a thorough understanding of the present technology. However, it will be apparent to one skilled in the art that the present technology may be practiced in other embodiments that depart from these specific details.

Referring now to the drawings, and particularly to FIGS. 1-16*b*, an embodiment of the downhole pulsation valve system and method of the present technology is shown and generally designated by the reference numeral 10.

In FIG. 1, a new and novel downhole pulsation valve system and method 10 of the present technology for reducing friction acting on a tool string and/or advancing the tool string by generating and utilizing pressure pulsations is illustrated and will be described. In the exemplary, the downhole pulsation system and method 10 can be utilized with a drill string or coiled tubing 2 that is associated with a bottom hole assembly (BHA) 8 in a wellbore 6. In typical operation, the coiled tubing 2 is run through a well head assembly 4 for insertion into the wellbore 6. It can be appreciated that the present technology can be utilized with jointed drill pipe or other drill string systems. The coiled tubing can provide fluid, hydraulic, electrical or communications to the BHA 8, and also provides a mechanical drive force to advance and retrieve the BHA 8 from the wellbore 6. The BHA 8 can include, but not limited to, a mud motor, a positive displacement motor (PDM), a measurement while drilling (MWD) tool, telemetry systems or other downhole tool assemblies. It can be appreciated that the present technology can be utilized with rigid drill strings.

Some benefits and advantages of the downhole pulsation valve system and method 10 can be that it reduces the friction acting on a tool string, such as the coiled tubing 2, being conveyed through a vertical or non-vertical wellbore 6, by way of the generation of pressure pulsations (vibrations). In doing this, the drill string or coiled tubing 2 can be conveyed or advanced further along the wellbore 6 before friction lock-up occurs.

In the oilfield industry, lock-up is known as a condition that may occur when a coiled tubing string is run into a horizontal (non-vertical) or highly deviated wellbore. Lock-up occurs when the frictional force encountered by the string running on the wellbore tubular reaches a critical point. Although more tubing may be injected into the wellbore, the end of the tool string cannot be moved farther into the wellbore. Helical buckling of the coiled tubing in the wellbore can be disastrous result of a lock-up condition. Coiled tubing, due to its inherent transverse flexibility, is generally more prone to buckling than strings consisting of threadably connected tubulars or jointed pipes.

Figure 2:
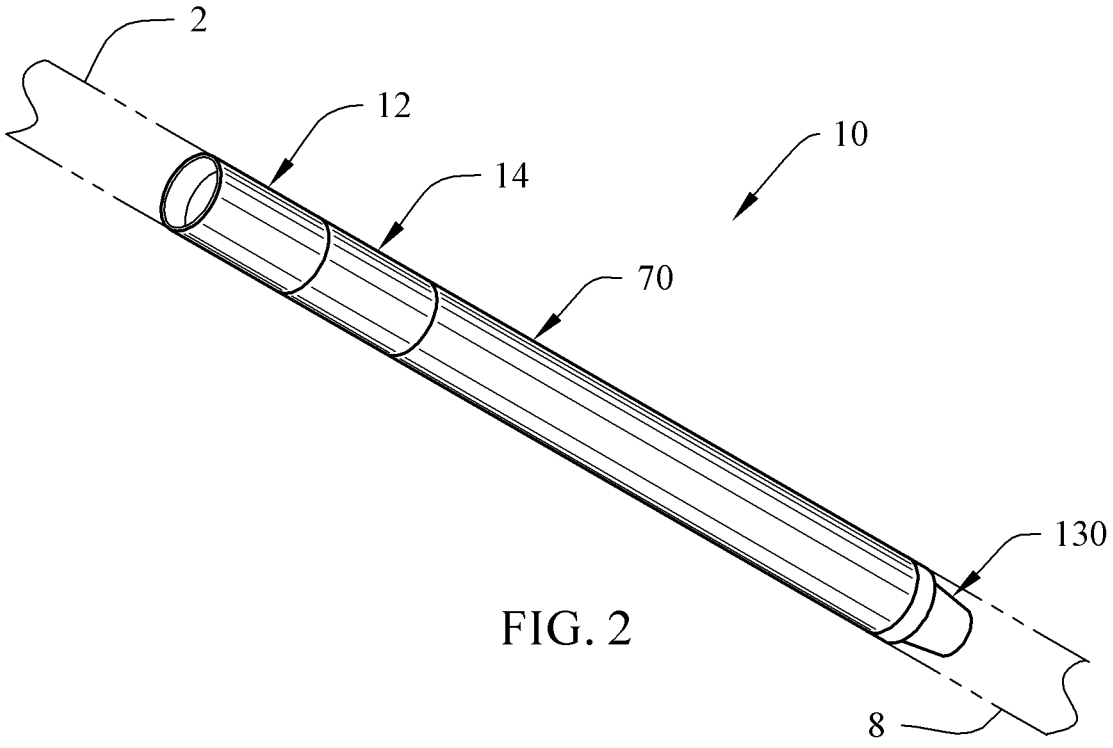
FIG. 2 is a perspective view of an assembled downhole pulsation valve system and method of the present technology.
Figure 3:
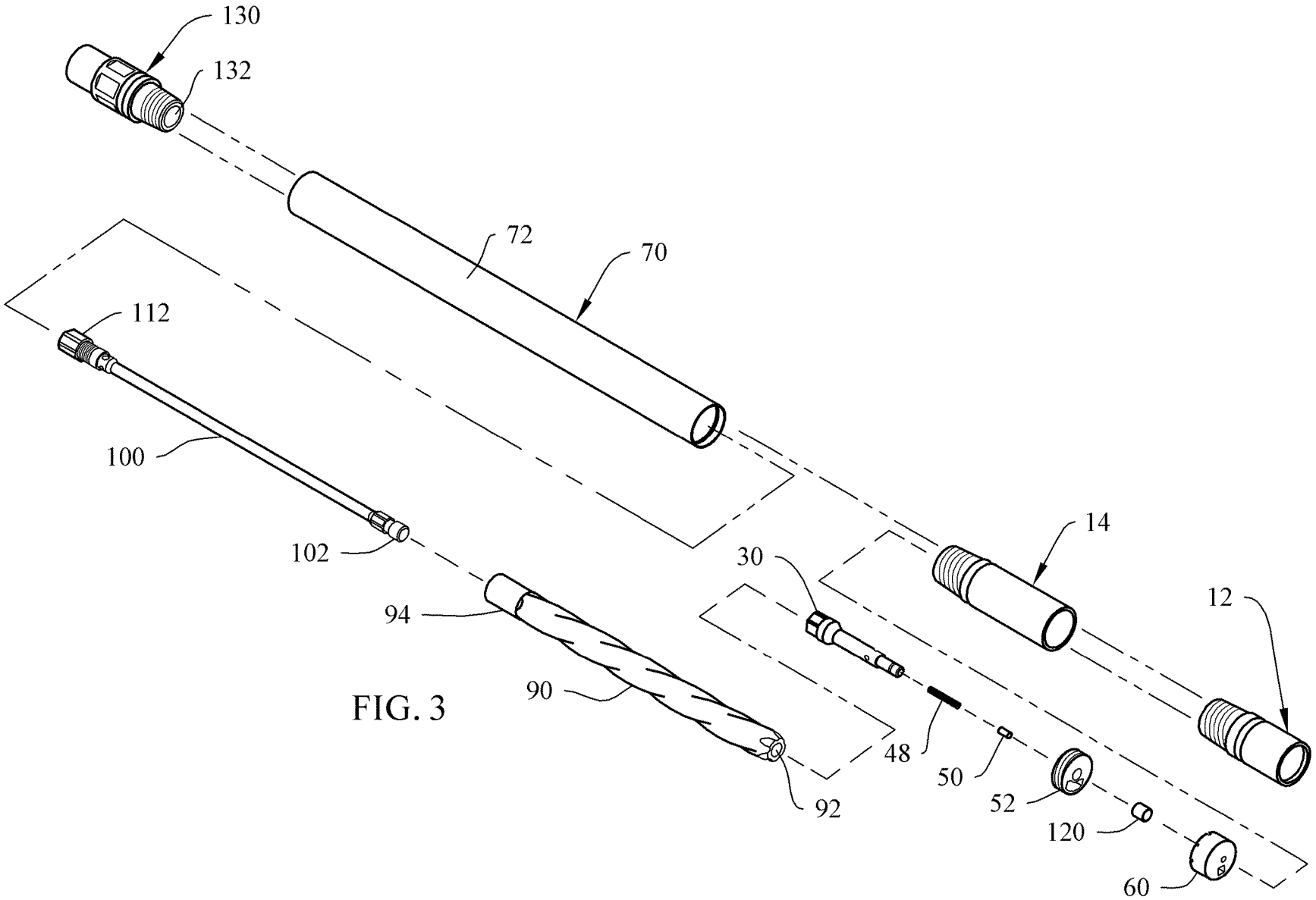
FIG. 3 is an exploded perspective view of the present technology.

Referring to FIGS. 2 and 3, the downhole pulsation valve system and method 10 can include a plurality of assemblies or modules connected together to create a single system that is attachable to the coiled tubing 2 and the BHA 8. The downhole pulsation valve system and method 10 can include a top sub 12, a valve sub assembly 14, an agitator or rotor/stator assembly 70 and a bottom sub 130. The downhole pulsation valve system and method 10, when assembled, can have a smooth outer surface with a diameter less than the wellbore 6, so it can easily be conveyed through the well head assembly 4 and wellbore 6.

Referring to FIGS. 4-8, the valve sub assembly 14 can include a valve assembly housing 16 that can include a bypass mandrel 30, a stationary valve head 52 and an oscillating valve head 60. The valve assembly housing 16 can include a first connection end 18 defining a first end bore 20, and a second connection end 22 defining a second end bore 24 in communication with the first end bore 20. The first connection end 18 can include external or internal coupling means or threading engageable with corresponding coupling means or threading of a second connection end of the top sub 12, so that fluid can be received in the first end bore 20 from an internal bore of the top sub 12.

The second connection end 22 can include external or internal coupling means or threading engageable with corresponding coupling means or threading 76 of a first connection end 74 of the rotor/stator assembly 70.

A width or diameter of the first end bore 20 can be less than a width or diameter of the second end bore 24 to create a ledge or stop edge 26.

The bypass mandrel 30 can include a central body 32, a first end or valve end section 38 and a second end or flexshaft end section 44. A longitudinal mandrel bore 34 is defined through the valve end section 38 and into in the central body 32. The central body 32 can have a first width or diameter. Multiple bypass bores 36 can be radially defined through the central body 32 at an angle and in communication with the mandrel bore 34. The angle of the bypass bores 36 can be from the mandrel bore 34 toward the flexshaft end section 44.

A biasing element or spring 48 can be received in the mandrel bore 34 so that one end thereof contacts an end wall of the mandrel bore 34 or a spring retaining element associated with the mandrel bore 34. A piston 50 can be slidable received in the mandrel bore 34 so that it contacts a second of the spring 48 and blocks or obstructs fluid flow from entering the bypass bores 36 when the piston is in a first position. Fluid flow from the mandrel bore 34 is permitted to flow through the bypass bores 36 when the piston 50 is pushed against the spring 48 in a second position thereby opening the bypass bores 36 to the mandrel bore 34.

The valve end section 38 can have a width or diameter less than the central body 32 thereby creating a stop edge 40. A section of the valve end section 38 near the stop edge 40 can have a smooth exterior surface, while a section near an open end of the valve end section 38 can include an external threaded section 42. The open end of the valve end section 38 defines an opening of the mandrel bore 34.

The flexshaft end section 44 can include exterior planar surfaces, and defining a cavity section 46 that can include internal coupling means or threading. The exterior planar surfaces can be arranged to create a geometrical configuration capable of being engaged with a tool for installation, removal or manipulation of the bypass mandrel 30.

The stationary valve head 52 is receivable and fixable in the second end bore 24 of the valve assembly housing 16, and can include a central bore 53 configured to receive a bushing 120. The central bore 53 can be defined along a longitudinal axis of the stationary valve head 52. A stationary valve bore 54 can be defined through the stationary valve head 52 in a direction parallel with a longitudinal axis of the central bore 53, and can have concentric arcuate or planar edges and parallel sides. With this configuration, the stationary valve bore 54 can have a width measured between its sides that is greater than a width or diameter of the central bore 53. Further in this configuration, the stationary valve bore 54 is offset from the central bore 53 along their parallel longitudinal axes.

Figure 4:
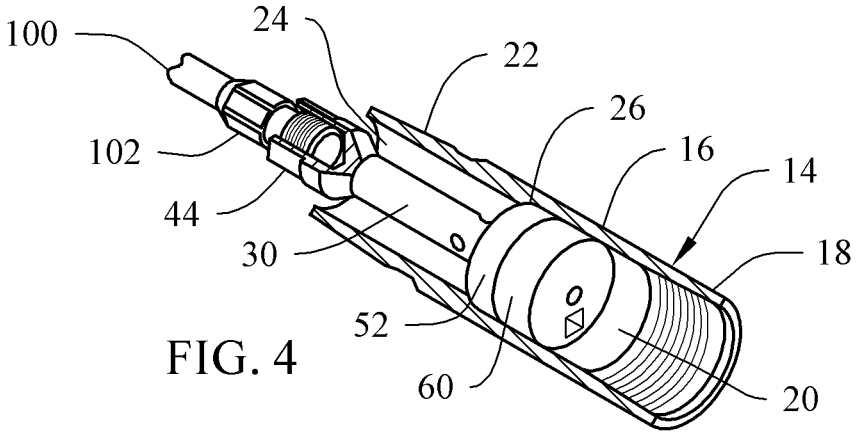
FIG. 4 is a cross-sectional perspective view of the valve assembly of the present technology.
Figure 5:
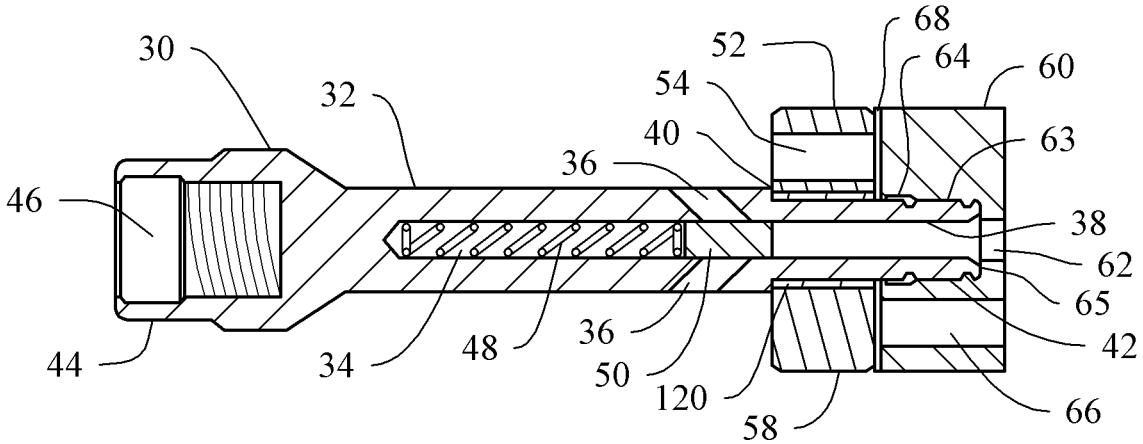
FIG. 5 is a cross-sectional view of the stationary valve head and oscillating valve assembly assembled on the bypass mandrel.
Figure 6:
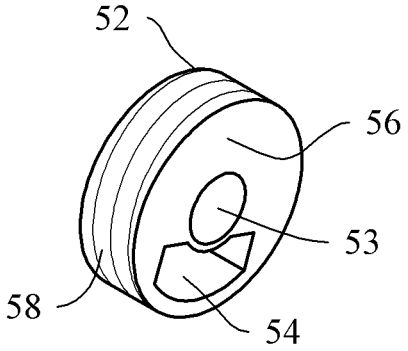
FIG. 6 is a perspective view of the stationary valve head of the present technology.
Figure 7:
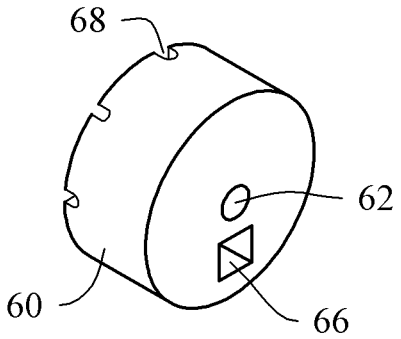
FIG. 7 is a perspective view of the oscillating valve assembly of the present technology.

An exterior surface of the stationary valve head 52 can include coupling means or threading 58 that is configured to engage with coupling means or threading 28 internally located in the second end bore 24 of the valve assembly housing 16. This allows the stationary valve head 52 to be non-rotatably fixed inside the second end bore 24, as best illustrated in FIGS. 4 and 5. In the exemplary, rotating the stationary valve head 52 threadably secures it to the valve assembly housing 16 until contact the stationary valve head 52 contacts the stop edge 26 and securing the stationary valve head 52 in place.

It can be appreciated that the stationary valve head 52 can have a non-cylindrical exterior configuration corresponding to a same non-cylindrical configuration of a receiving section of the second end bore 24, thereby prohibiting the stationary valve head 52 from rotating when received therein.

The oscillating valve head 60 is receivable and rotatable in the second end bore 24 of the valve assembly housing 16, a first bore 62 and a second bore 64 in communication with the first bore 62. The second bore 64 can include coupling means or internal threading 63 configured to engage with the external threading 42 of the valve end section 38 of the bypass mandrel 30.

The first bore 62 can have a width or diameter less than second bore 64 to create a ledge or stop edge 65 that can contact the free end of the valve end section 38 when the oscillating valve head 60 is coupled to the valve end section 38. A length of the second bore 64 to the stop edge 65 can be sufficient to provide a gap between the stop edge 40 of the bypass mandrel 30 and the oscillating valve head 60 that freely receives the stationary valve head 52 therebetween.

An oscillating valve bore 66 is defined through the oscillating valve head 60 parallel with a longitudinal axis thereof. A cross-sectional or lateral profile of the oscillating valve bore 66 can be the same or less than a cross-sectional or lateral profile of the stationary valve bore 54. Alternatively, a radial length of the stationary valve bore 54 can be greater than a width or diameter of the oscillating valve bore 66.

A location of the oscillating valve bore 66 can be offset from the first bore 62 and alignable with the stationary valve bore 54 when the stationary valve head 52 and the oscillating valve bore 66 are assembled in the valve assembly housing 16. In this configuration, the oscillating valve bore 66 can be in or out of communication with the stationary valve bore 54 during rotation of the oscillating valve head 60 in relation with the stationary valve head 52.

It can be appreciated that the oscillating valve bore 66 can have a size smaller than that of the stationary valve bore 54, thereby allowing the oscillating valve bore 66 to be in communication with the stationary valve bore 54 at predetermined radial positions. The amount of time the oscillating valve bore 66 and the stationary valve bore 54 are in communication with each other can be dependent on the size of the oscillating valve bore 66, the size of the stationary valve bore 54, the number of oscillating valve bores 66 and/or stationary valve bores 54, and/or the rotational speed of the oscillating valve bores 66.

Grooves or slots can be defined in an internal surface defining the first end bore 20 of the valve assembly housing 16, and configured to retaining fluid on an outside of the oscillating valve head 60 thereby creating a hydrodynamic bearing between the perimeter of the oscillating valve head 60 and internal surface defining the second end bore 24.

An end side of the oscillating valve head 60 that faces the stop edge 40 when assembled can include a plurality of channels 68. The channels 68 can be radially defined in communication with an exterior of the oscillating valve head 60 and the second bore 64. It can be appreciated that the channels 68 can be further defined radially in communication with an exterior of the stationary valve head 52 and the second bore 64 so that the channels of the stationary and oscillating valve heads 52, 60 face each other. These channels 68 can be configured to allow fluid to flow between adjacent surfaces of the stationary valve head 52 and the oscillating valve head 60 allowing for lubrication therebetween, as well as a contact area 122 between the bushing 120 and the valve end section 38 of the bypass mandrel 30.

The bushing 120 can be received in the central bore 53 and can be configured for receiving the smooth exterior surface portion of the valve end section 38. The bushing 120 can allow for smooth and free rotation of the valve end section 38 of the bypass mandrel 30 within the central bore 53 of the stationary valve head 52. Further, the bushing 120 can be easily replaced if significant wear or damage is detected on the bushing 120. It can be appreciated that the bushing 120 can be a sacrificial part as compared to the bypass mandrel 30 and/or the stationary valve head 52, and can be made of any suitable material.

When assembled, it can be appreciated that the valve end section 38 is insertable through the bushing 120 and as such the central bore 53 of the stationary valve head 52. The oscillating valve head 60 is secured to the valve end section 38 so that the stationary valve head 52 freely positioned between the stop edge 40 and the end side of the oscillating valve head 60 including the channels 68. The stop edge 40 can be configured to prevent the bypass mandrel 30 from sliding out of place and/or to keep the bushing 120 within the central bore 53.

Referring to FIGS. 9-11, the rotor/stator assembly 70 includes a stator housing 72, a stator 86, and a rotor 90. The rotor/stator assembly 70 can be configured to be a progressing-cavity rotor/stator combination provides rotational power to turn the rotor relative to the stator. The stator housing 72, as best illustrated in FIG. 9, defines an axial cavity or stator housing bore 78 therethrough, and includes a first connection end 74 featuring coupling means or threading 76 capable of being engageable with the corresponding coupling means or threading of the second connection end 22 of the valve assembly housing 16, thereby stator housing 72 and the valve assembly housing 16. It can be appreciated that seals can be utilized between the first connection end 74 of the stator housing 72 and the second connection end 22.

It can further be appreciated that different valve subassemblies 14 can utilized thereby making the valve sub assembly 14 a module component in the overall aspect of the present technology. Further, the valve assembly housing 16 may be integrally formed with the stator housing 72, thereby creating a combined valve and rotor/stator assembly unit.

A second connection end 80 of the stator housing 72, as best illustrated in FIGS. 9 and 11 can feature coupling means or threading 82. Further, the stator housing bore 78 can have a width or diameter greater than a width or diameter of a through bore defined in the second connection end 80, thereby creating a ledge or stop edge 84.

The stator 86 can be received in the stator housing bore 78 of the stator housing 72 and fittingly secured thereto, so that the stator 86 and stator housing 72 is substantially a single unit. The stator 86 can be a tubular extension defining an axial cavity or stator bore 88 therethrough, and extending in the longitudinal direction of the stator housing 72. The stator bore 88 is in communication with the stator housing bore 78, so as to receive fluid from the valve assembly housing 16. The stator 86 can include multiple lobes extending into the stator bore 88 or can have a smooth internal surface.

The rotor 90 includes a first end 92, a longitudinal bore 94 defined therethrough, and a second connection end 96. The first end 92 can be an open free end, and the second connection end 96 can include internal coupling means or threading 98.

As best illustrated in FIG. 9, the rotor 90 can include exterior planar surfaces that can be part of or adjacent the first end 92 and/or the second connection end 96. The external planar surfaces can be arranged to create a geometrical configuration capable of being engaged with a tool for installation, removal or manipulation of the rotor 90. One or more helical or spiral lobes 91 are configured along a part of a longitudinal length of the rotor 90.

Figure 12:
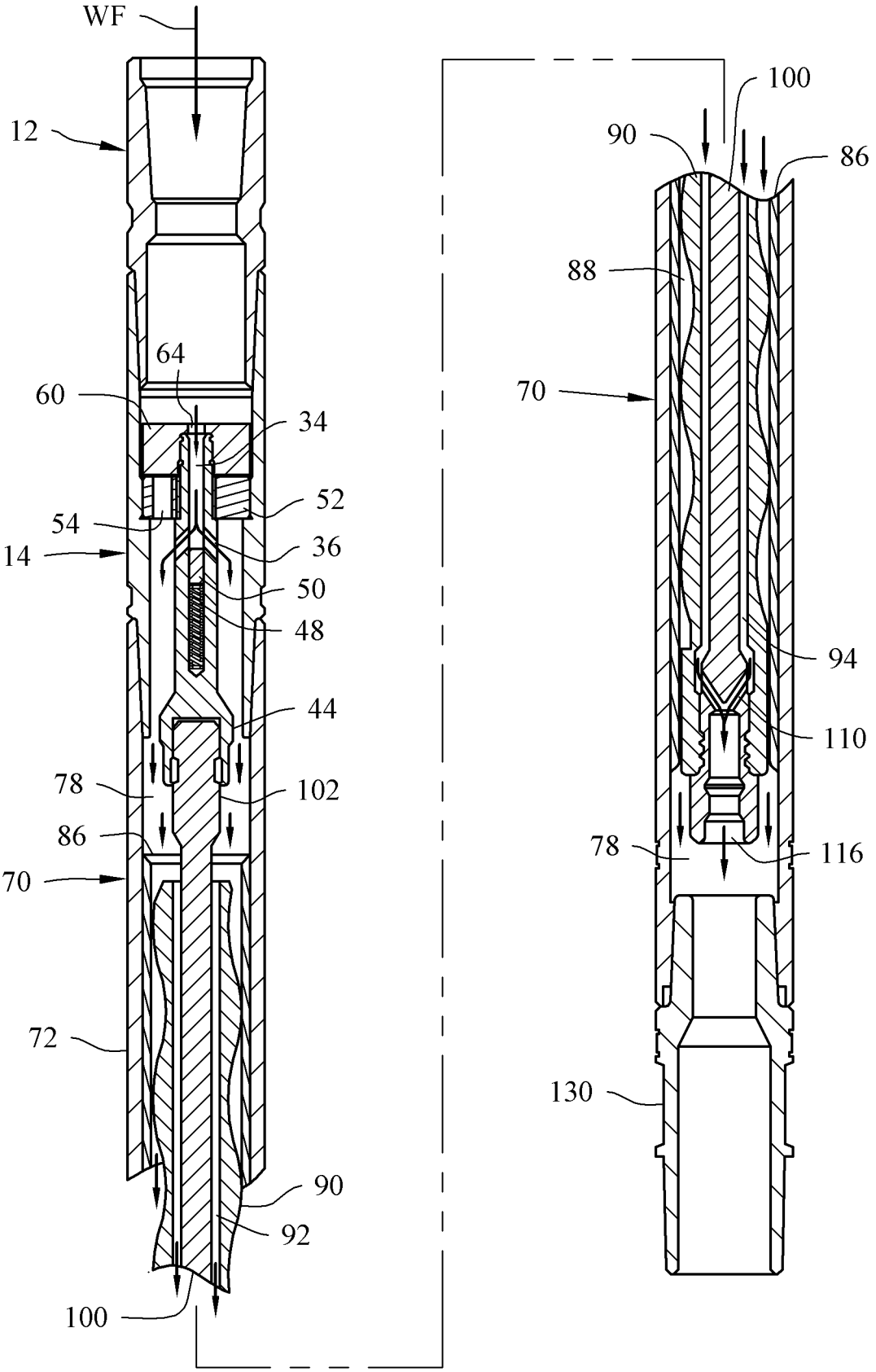
FIG. 12 is a cross-sectional view of the assembled downhole pulsation valve system and method of the present technology with the oscillating valve assembly in a closed position or when first encountering the pumped fluid.
Figure 13:
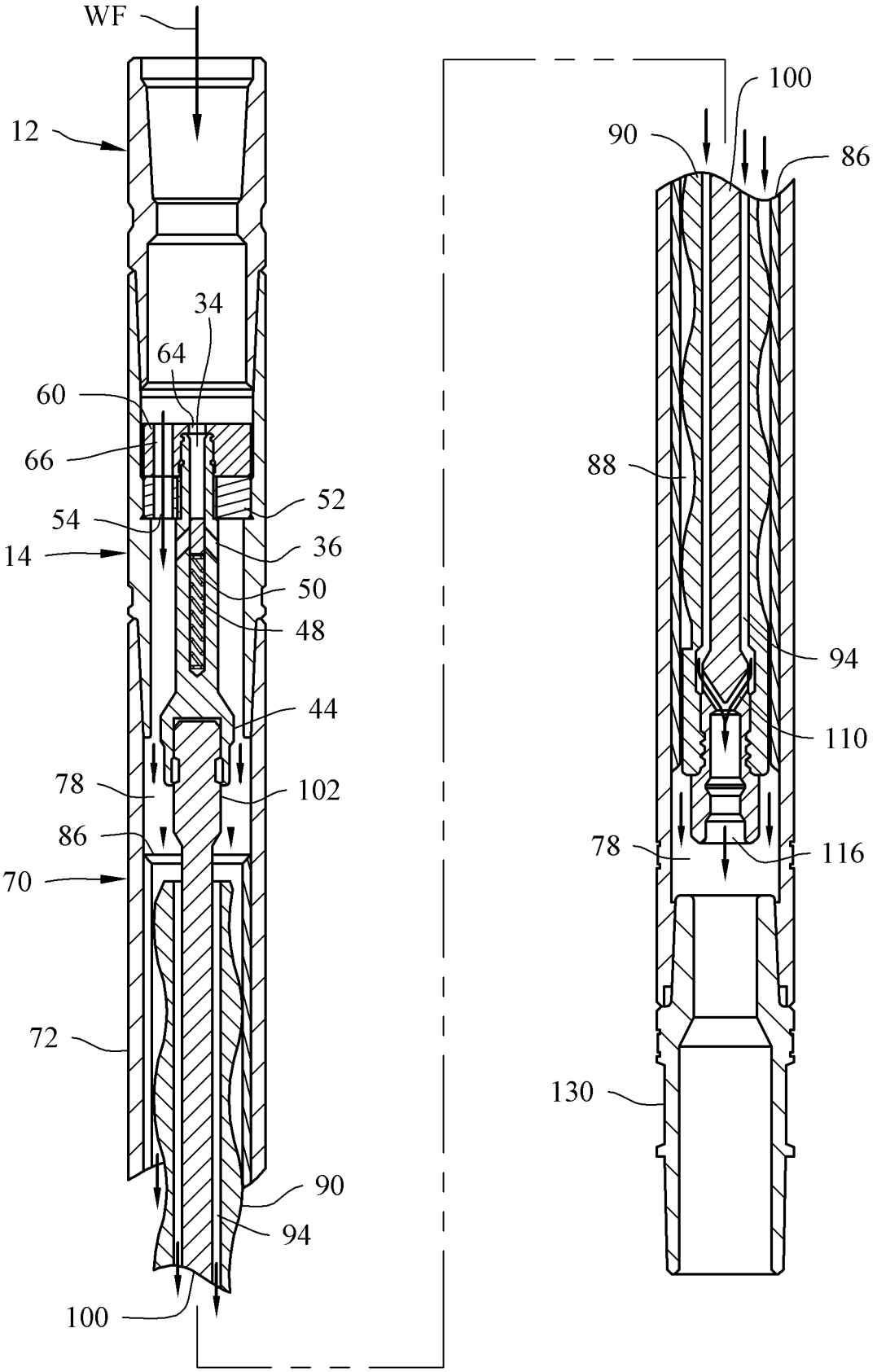
FIG. 13 is a cross-sectional view of the assembled downhole pulsation valve system and method of the present technology with the oscillating valve assembly in an opened or partially opened position resulting from rotation by the rotor/stator assembly.

The rotor 90 is slidably and rotatably received in the stator bore 88, with lobes or internal surface of the stator 86 and the lobes 91 or the rotor 90 being complimentary to or with each other. The complimentary configuration of the lobes is capable of rotation of the rotor 90 relative to the stator 86 responsive to a flow of fluid traveling through stator bore 88, as best illustrated in FIGS. 12-13.

A driveshaft or flexshaft 100, as best illustrated in FIGS. 10-11, can include a first connection end 102 featuring external coupling means or threading 103, a first set of exterior planar surfaces 104 part of or adjacent with the first connection end 102, a shaft section 106, a second set of external planar surfaces 113, and a second connection end 112 featuring external coupling means or threading 108. The second set of external planar surfaces 113 can be part of or adjacent with the second connection end 112.

The flexshaft 100 is receivable in the longitudinal bore 94 of the rotor 90, and is configured to create an annulus between the flexshaft 100 and the longitudinal bore 94, thereby allowing fluid from the stator housing bore 78 to travel therethrough pass the flexshaft 100.

The external threading 103 of the first connection end 102 is capable of being engageable with the internal threading of the cavity section 46 of the flexshaft end section 44 of the bypass mandrel 30, thereby joining the flexshaft 100 and the bypass mandrel 30. It can be appreciated that seals can be utilized between the first connection end 102 of the rotor 90 and the cavity section 46 of the flexshaft end section 44 of the bypass mandrel 30.

The threading 108 of the second connection end 112 can be configured to engage with the internal threading 98 of the second connection end 96 of the rotor 90, thereby securing the rotor 90 with the flexshaft 100. It can be appreciated that any rotation and/or oscillation of the rotor 90 produced fluid flow through the stator bore 88 and about the lobes 91 would be conveyed to the flexshaft 100 and accordingly to the bypass mandrel 30 and the oscillating valve head 60 attachable thereto.

Adjacent to the second connection end 112 between the threading 108 and the shaft section 106 can be defined a plurality of ports 110. The ports 110 can be angled or tapered toward each other from a direction of the shaft section 106 toward the second connection end 112.

A second end cavity 114 can be defined in the second connection end 112 that is in communication with an open end 116 of the second connection end 112. Consequently, fluid flowing through the longitudinal bore 94 of the rotor 90 would enter the ports 110 and then travel into the second end cavity 114 and out the open end 116 for use downstream thereof.

It can be appreciated that the second end cavity 114 or the open end 116 can include internal coupling means or threading 118 for engagement with complimentary coupling means of a downhole tool or component, a drill string or conduit, or any other downhole element.

A plug or a restricting orificed plug (not shown) can be received in the open end 116 and secured therein by the threading 118. This plug can prevent flow from bypassing the flexshaft 100.

It can be appreciated that seals can be utilized between any element attached with the second connection end 112, the open end 116 and/or the second end cavity 114.

The first and second set of external planar surfaces 104, 113 can be arranged to create a geometrical configuration capable of being engaged with a tool for installation, removal or manipulation of the flexshaft 100.

The flexshaft 100 is configured or capable of undergoing nutation as well as rotation, this can be accomplished with the flexshaft 100 having sufficient transverse flexibility. The shaft section 106 can have a diameter less than the first and second ends or sufficient enough to provide the transverse flexibility required of the present technology.

The bottom sub 130 defines an axial bottom sub bore or cavity 132 therethrough, and includes a first connection end featuring external coupling means or threading capable of being engageable with the internal threading 82 of the second connection end 80 of the stator housing 72, thereby joining the stator housing 72 and the bottom sub 130. It can be appreciated that seals can be utilized between the first connection end of the bottom sub 130 and the second connection end 80 of the stator housing 72.

The bottom sub 130 can include a pin connection end capable of coupling with the BHA 8 or a drill motor top sub. It can be appreciated that seals can be utilized between a first connection end of the bottom sub 130 and the second connection end 80 of the stator housing 72.

In use, it can now be understood that pressurized fluid flowing through the progressing-cavity of the rotor/stator assembly 70 provides rotational power to turn the rotor 90 relative to the stator. It can be appreciated that the stator 86 can be rigidly connected to the BHA 8, either directly or by way of the stator housing 72.

Referring to FIGS. 12-13 and in the exemplary, the downhole pulsation valve system and method 10 can be assembled with the valve assembly housing 16 connected in series to the drill string 2 either directly or via the top sub 12, and the stator housing 72. The stator housing 72 can then be connected to the BHA 8 either directly or via the bottom sub 130. The drill string 2, downhole pulsation valve system 10 and the BHA 8 can be introduced and advanced through the wellbore 6 for downhole operations.

Prior to attaching the valve assembly housing 16 to the drill string 2 or the top sub 12, the stationary valve head 52 is secured inside the first end bore 20 of the valve assembly housing 16 via the coupling means or threading 28, 58. After which, the valve end section 38 of the bypass mandrel 30 can be inserted through the central bore 53 of the stationary valve head 52. Then, the first bore 62 of the oscillating valve head 60 can be positioned to receive the valve end section 38 and secured together via the coupling means or threading 42, 63. In this assembled configuration, the bypass mandrel 30 and the oscillating valve head 60 are rotatable within the first and second end bores 20, 24 and in relation to the stationary valve head 52.

Working fluid WF is pumped through the drill string or coiled tubing 2, which enters the valve sub assembly 14.

It can be appreciated that the stationary and oscillating valve heads 52, 60 can be in a closed position, a partially open position and/or a fully open position depending on rotation of the oscillating valve head 60. In the closed position, the oscillating valve bore 66 is not in communication with the stationary valve bore 54. In the partially open position, the oscillating valve bore 66 is in communication or in partial communication with the stationary valve bore 54 of the stationary valve head 52. In the fully open position, the oscillating valve bore 66 is in full communication with the stationary valve bore 54.

Figure 8:
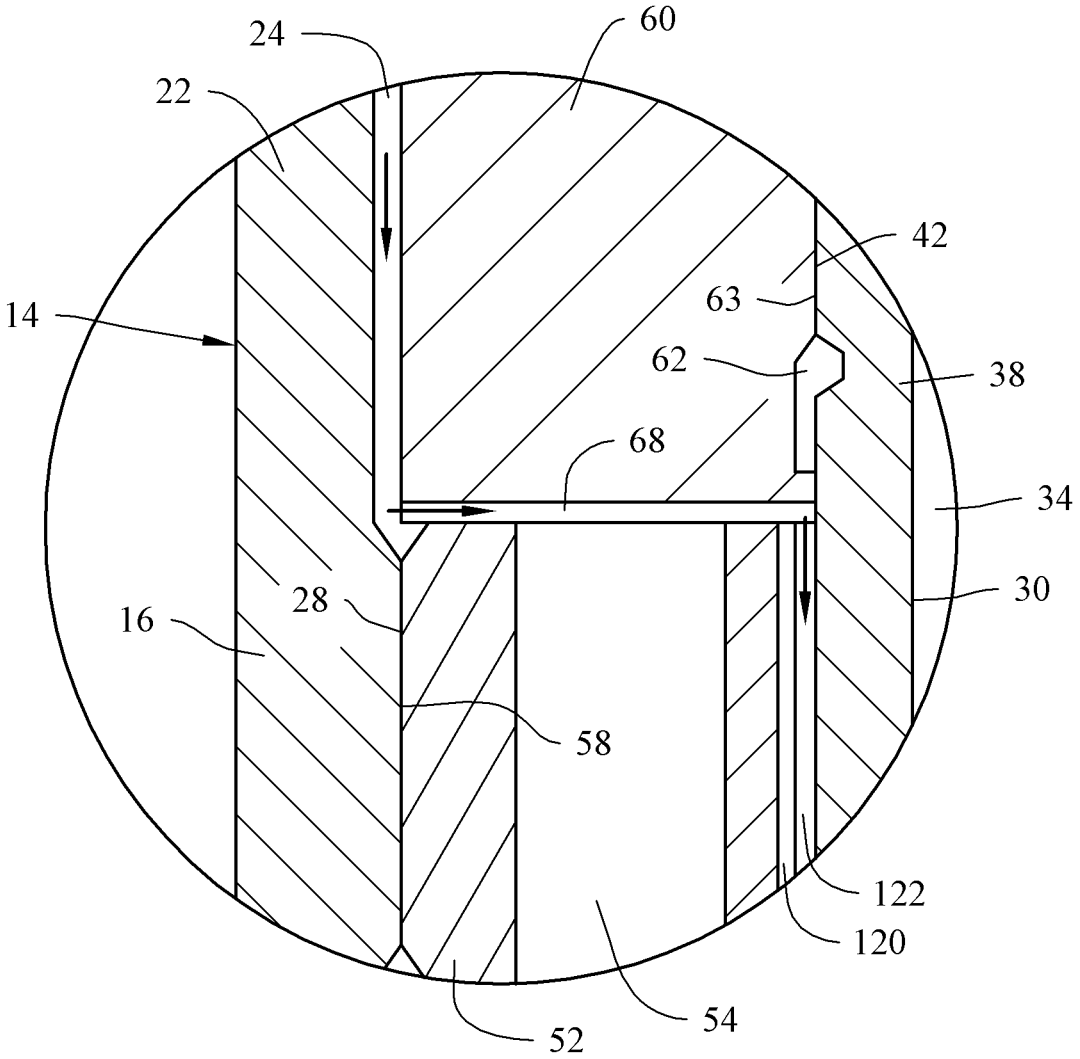
FIG. 8 is an enlarged cross-sectional view of the hydrodynamic bearing associated with the stationary valve head and the oscillating valve assembly.

If the stationary and oscillating valve heads 52, 60 are in the closed position, and when first encountering the pumped working fluid WF, then the flow is diverted radially outwards on the face of the oscillating valve head 60 and pushed in between the outside of the oscillating valve head 60 and the inside of the valve assembly housing 16 defining the first end bore 20. This flow is retained on the outside of the oscillating valve head 60 via grooves or slots defined in an internal surface defining the first end bore 20, creating a hydrodynamic bearing in between the perimeter of the oscillating valve head 60 and the wall of the valve assembly housing 16, as best illustrated in FIGS. 8 and 12. The fluid can then flow into the channels 68 extended radially from a center to outside, on the face of one or both of the stationary and oscillating valve heads 52, 60. This fluid flow allows for lubrication of the face-to-face contact between the stationary and oscillating valve heads 52, 60, as well as the contact between the bushing 120 and the bypass mandrel 30.

Further in this closed position, fluid pressure from the working fluid WF is higher than when in the partially or fully open position. This increased pressure provides fluid flow can be diverted into the first bore 62 on the face of the oscillating valve head 60 and into the inside of the mandrel bore 34 of the bypass mandrel 30, thereby pushing on the piston 50 slidably nested within mandrel bore 34.

The fluid flow pushing on the piston 50 results in the piston 50 being pushed against the spring 48 and away from the bypass bores 36 thereby allowing the fluid flow to exit the mandrel bore 34 through the bypass bores 36 and into the second end bore 24 of the valve assembly housing 16. The spring 48 can be designed to collapse at a predetermined pressure that is higher than pressures encountered during a water hammer phenomenon, consequently allowing fluid flow to be diverted past the valve sub assembly 14 and into the power section of the rotor/stator assembly 70. This allows for start-up rotation of the rotor 90 and consequently the bypass mandrel 30 and the oscillating valve head 60 by way of the flexshaft 100.

This startup rotation or continued rotation of the rotor 90 can be provided in that the working fluid travels through rotor/stator assembly 70. Upon which, nutation and rotation is imparted onto the rotor 90, which consequently rotates the flexshaft 100 that consequently rotates the bypass mandrel 30 that rotates the oscillating valve head 60 between the closed, partially opened and fully opened positions, as best illustrated in FIG. 13.

It can be appreciated that during rotation of the rotor 90, rotation of the oscillating valve head 60 is made concentric through use of the nested flexshaft 100, housed within the longitudinal bore 94 of the rotor 90, in combination with the bushing 120 placed inside of the central bore 53 of the stationary valve head 52. The bushing 120 can be retained by the stop edge 40 or by a lip on the downstream face of the stationary valve head 52.

The flexshaft 100, mated to the bypass mandrel 30 on an upstream side of the rotor 90, can take the primary loading to the transfer of eccentric rotation of the rotor 90 to concentric rotation at the bypass mandrel 30.

As the oscillating valve head 60 rotates, it encounters periods of flow going into the oscillating valve bore 66 and periods of blocked flow based on the mating design between the stationary valve bore 54 of the stationary valve head 52 and the oscillating valve bore 66 of the oscillating valve head 60. Accordingly creating a water hammer phenomenon within the tubing and BHA 8.

An axial travel of the power section of the rotor/stator assembly 70 can be limited by the stop edge 40 of the bypass mandrel 30 on the downstream side of the stationary valve head 52, and the face of the oscillating valve head 60 on the upstream side of the stationary valve head 52.

The flexshaft 100 can have an optional bypass plug on the downstream side of the rotor 90, allowing for adjustable rotor speeds at a specified flow rate.

Flow exiting the rotor/stator assembly 70 can pass through the bottom sub 130 and continue downstream to the BHA 8.

Figure 14A:
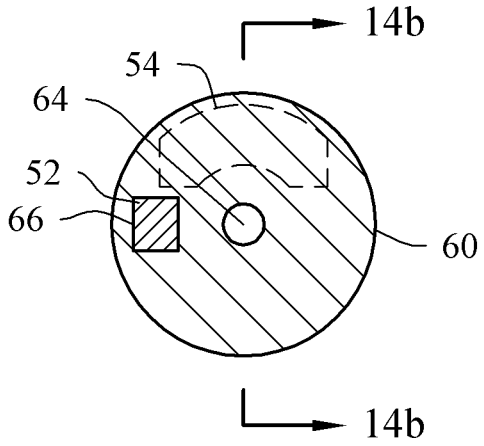
FIGS. 14*a* and 14*b* are cross-sectional views of the oscillating valve assembly in a closed position, with FIG. 14*b* taken along line 14*b*-14*b* in FIG. 14*a*.
Figure 14B:
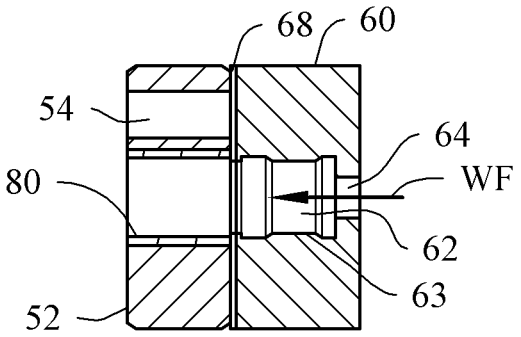

Referring to FIGS. 14*a*-16*b*, the closed, partially opened and fully opened positions of the stationary and oscillating valve heads 52, 60 are shown and will be described in more detail. The closed position, as best illustrated in FIGS. 14*a* and 14*b*, shows the oscillating valve bore 66 not in communication with either the stationary valve bore 54. In this closed position, the working fluid WF primary travels through the first bore 62 by way of the second bore 64 and into the mandrel bore 34 and pushes the piston 50 away from the bypass bores 36.

Figure 15A:
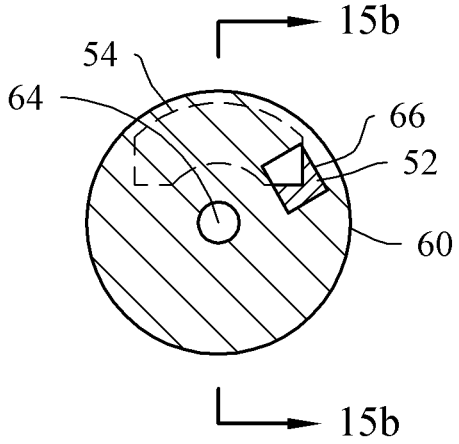
FIGS. 15*a* and 15*b* are cross-sectional views of the oscillating valve assembly in a partially opened position, with FIG. 15*b* taken along line 15*b*-15*b* in FIG. 15*a*.
Figure 15B:
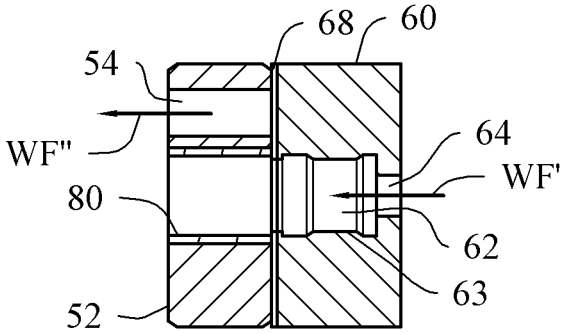

During rotation of the rotor 90, the oscillating valve head 60 rotates into the partially opened position, as best illustrated in FIGS. 15*a* and 15*b*. In this partially opened position, a first portion of the working fluid WF' enters the first bore 62 and a second portion of the working fluid WF" enters the oscillating valve bore 66 and then the stationary valve bore 54 of the stationary valve head 52. The second portion of the working fluid WF" entering the stationary valve bore 54 is dependent on an amount of the oscillating valve bore 66 that is overlapping or in communication with the stationary valve bore 54, as best illustrated in FIG. 15*a*.

It can be appreciated that an amount of the second portion of the working fluid WF" traveling through the stationary valve bore 54 is dependent on the position of the oscillating valve bore 66.

As the oscillating valve head 60 rotates further into the partially opened position, more of the second portion of the working fluid WF" enters the stationary valve bore 54 resulting in a decrease of pressure of the first portion of working fluid WF' acting against the piston 50. When the first portion of the working fluid WF' is a predetermined pressure, the spring 48 will push the piston 50 into a blocking position covering the bypass bores 36, thereby stopping the first portion of the working fluid WF' from entering the mandrel bore 34.

It can be appreciated that the amount of the first and second portions of the WF', WF" entering the first bore 62 and the oscillating valve bore 66 is dependent on the rotational position of the oscillating valve bore 66 in relation with the stationary valve bore 54.

Figure 16A:
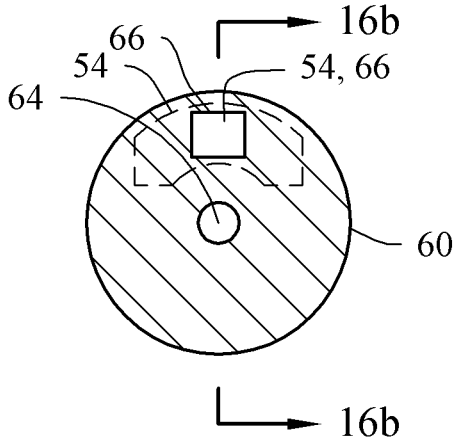
FIGS. 16*a* and 16*b* are cross-sectional views of the oscillating valve assembly in a fully opened position, with FIG. 16*b* taken along line 16*b*-16*b* in FIG. 16*a*.
Figure 16B:
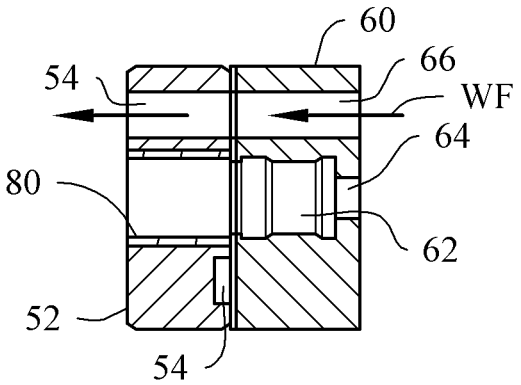

During further rotation of the rotor 90, the oscillating valve head 60 rotates into the fully opened position, as best illustrated in FIGS. 16*a* and 16*b*. In this fully opened position, oscillating valve bore 66 is fully or substantially aligned with the stationary valve bore 54, thereby allowing the working fluid WF to freely travel through the stationary and oscillating valve bores 54, 66. It can be appreciated that a small amount of working fluid may travel through the first bore 62 by way of the second bore 64 and into the mandrel bore 34, however the fluid pressure would not be sufficient to push the piston 50 away from the bypass bores 36.

According to one aspect and in the exemplary, the present technology can include a pulsation valve system 10 including a bypass mandrel 30, an oscillating valve head 60 and a stationary valve head 52. The mandrel 30 can be operably coupled to a rotor 90 of a pulsation assembly 70. The mandrel 30 can include a mandrel bore 34 defined through a first mandrel end 38 and along a longitudinal axis of the mandrel 30. The mandrel 30 can further include bypass bores 36 defined at an angle through the mandrel 30 and in communication with the mandrel bore 34.

A spring 48 can be locatable in the mandrel bore 34, and a piston 50 can be slidably receivable in the mandrel bore 34 in operable contact with the spring 48. The piston 50 can be configured to block an entrance of the bypass bores 36 from inside the mandrel bore 34 at a first position and to allow fluid to flow into the bypass bores 36 from inside the mandrel bore 34 at a second position.

The oscillating valve head 60 can be attachable to the mandrel 30 and rotatable with the mandrel 30. The oscillating valve head 60 can include an oscillating valve bore 66 defined therethrough and parallel with a longitudinal axis of the oscillating valve head 60.

The stationary valve head 52 can be positioned adjacent and stationary with respect to the oscillating valve head 60. The stationary valve head 52 can include a stationary valve bore 54 defined therethrough and parallel with a longitudinal axis of the stationary valve head 52. The oscillating valve bore 66 can be alignable with the stationary valve bore 54 at predetermined rotational positions.

The mandrel bore 34 can be in communication with a first central bore 62 of the oscillating valve head 60.

The spring 48 can be configured to allow the piston 50 to move to the second position when a predetermined fluid pressure is provided on the piston 50 from the mandrel bore 34 received from the first central bore 62.

According to another aspect and in the exemplary, the present technology can include a method of using a pulsation valve system 10 for oscillating fluid flow to a pulsation assembly 70. The method can include the steps of flowing a working fluid WF to an oscillating valve head 60 that is attachable to a mandrel 30 operably coupled to a rotor 90 of the pulsation assembly 70, and then to the rotor 90 of the pulsation assembly 70 to impart rotation of the mandrel 30 and the oscillating valve head 60 with respect to a stationary valve head 52 positioned adjacent and stationary with respect to the oscillating valve head 60. Then rotating the oscillating valve head 60 so that an oscillating valve bore 66 defined through the oscillating valve head 60 comes in and out of alignment with the stationary valve bore 54 defined through the stationary valve head 52. Controlling a flow of the working fluid WF entering the pulsation assembly 70 dependent on the rotational location of the oscillating valve bore 66 in relation to the stationary valve bore 54.

In some embodiment, the clearance or size of the stationary valve bore 54 can control a pulsation magnitude being: a smaller clearance or size=larger pulsation magnitude; and a larger clearance or size=smaller pulsation magnitude.

In some embodiment, the size of the oscillating valve bore 66 can control a pulsation magnitude being: a smaller size=larger pulsation magnitude; and a larger size=smaller pulsation magnitude.

Further to the above description, the flexshaft 100 undergoes nutation as well as rotation at one end due to the rotor's complex motion. At its first connection end 102, it delivers pure concentric rotation to the bypass mandrel 30. In some embodiments, this can be accomplished with the flexshaft 100 having sufficient transverse flexibility. It can be appreciated that other types of driveshafts can be utilized in place of the flexshaft.

The cyclic obstruction of the stationary valve bore 54 and/or the oscillating valve bore 66 can lead to a fluctuating total flow area (TFA). The TFA is at a maximum while the stationary and oscillating valve bores 54, 66 are completely unobstructed, as per the fully opened position. The TFA is at a minimum while the stationary and oscillating valve bores 54, 66 are fully obstructed, as per the closed position. The cyclic variation of TFA from its maximum to minimum condition causes a pressure spike within the fluid upstream of the stationary and oscillating valve bores 54, 66. This phenomenon is commonly referred to as "Water Hammer".

The flow rate through the stationary and oscillating valve bores 54, 66 achieves a maximum ($Q_{max}$) while fully unobstructed and reaches a minimum ($Q_{min}$) while fully obstructed. The magnitude of the pressure spike is proportional to the difference between the maximum and minimum flow rate ($\Delta Q = Q_{max} - Q_{min}$).

The time-averaged flow rate through the stationary and oscillating valve bores 54, 66 can be dependent on the pump rate at the surface, which supplies the working fluid downhole. Increasing the pump rate increases $\Delta Q$, which in turn increases the pressure spike magnitude.

The rotor's rotational speed can be dependent on the pump rate at the surface. Increasing the pump rate increases the rotor's rotational speed. Being that the oscillating valve head 60 is rotationally coupled to the rotor 90, increasing the pump rate will increase the pressure spike frequency.

The magnitude of the pressure spike is also proportional to the "system's" hydraulic impedance, which, from an internal pressure perspective, is a measure of the "system's" rigidity. Hydraulic impedance is generally defined as the ratio of pressure to volume flow rate. The pressure and volume flow variables are treated as phasors in this definition, so possess a phase as well as magnitude. The "system" consists of the upstream fluid itself as well as the tubular components (coiled tubing, etc.) though which the upstream fluid is conveyed. The length of the "system" is the product of the "system's" effective speed of sound and the duration of time that the port(s) is obstructed.

In some embodiments, the rotor/stator assembly 70 connects in series into or to the BHA 8, and does not require any input from other BHA components other than fluid communication.

Bearings or the bushing 120 associated with the stationary valve head 52 can be cooled and lubricated via bypass fluid flow in the channels 68 and/or the contact area 122. The amount of fluid permitted to bypass can be controlled by fluid restrictors. The bypass flow rate ($Q_{bp}$) is substantially smaller than $Q_{min}$.

In some embodiments, the oscillating valve head 60 can be driven by a rotor of a drilling motor situated directly downstream of the present technology system. The drilling motor's rotor catch function should be retained. For this reason, the flexshaft is rotationally coupled to a modified rotor catch device rather than directly to the rotor itself. As well, the flexshaft housing threadably connects to a top sub of the drilling motor rather than the stator itself. The top sub of the drilling motor can furnish an internal shoulder feature, which is essential to the rotor catch function.

The bushing 120 of the present technology can be configured to not axially constrain or limit the axial movement of the rotor 90, which may be already constrained by a bearing pack of the drilling motor. As such, an expansion/retraction (telescoping) feature can be provided at some location in between the rotor 90 and the bushing 120.

Some embodiments of the present technology can include the rotor/stator assembly as being installed in series within an existing drilling motor, which does not require modifications to any of the drilling motors components. The oscillating valve head 60 is rigidly connected in series with a flexshaft and a bearing mandrel of the drilling motor. Therefore, the oscillating valve head 60 does not require dedicated bearing support since the bearing mandrel is already well supported by the drilling motor's bearings.

Further, because the oscillating valve head 60 is rigidly connected to the flexshaft, its rotation is provided via the drilling motor's power section. For this reason, a dedicated means of rotating the oscillating valve head 60, such as a dedicated power section and/or driveshaft, may not require either.

As a further consequence of being rigidly connected in series with the flexshaft and bearing mandrel of the drilling motor, the oscillating valve head 60 can be of sufficient torsional strength to reliably transmit the relatively high torque that a drilling motor's drive-line is subject to.

A housing, threadably connected between the flexshaft and bearing mandrel of the drilling motor, of make-up length corresponding to the oscillating valve head 60 make-up length can be provided to maintain correct alignment of the drilling motor's drive-line components.

While embodiments of the downhole pulsation valve system and method have been described in detail, it should be apparent that modifications and variations thereto are possible, all of which fall within the true spirit and scope of the present technology. With respect to the above description then, it is to be realized that the optimum dimensional relationships for the parts of the present technology, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present technology. For example, any suitable sturdy material may be used instead of the above-described. And although providing oscillating fluid flow to a pulsation and/or agitation device for reducing friction acting on a tool string and/or advancing the tool string have been described, it should be appreciated that the downhole pulsation valve system and method herein described is also suitable for providing a valve assembly for providing oscillating fluid flow to a tool or assembly downstream thereof.

Therefore, the foregoing is considered as illustrative only of the principles of the present technology. Further, since numerous modifications and changes will readily occur to those skilled in the art, it is not desired to limit the present technology to the exact construction and operation shown and described, and accordingly, all suitable modifications and equivalents may be resorted to, falling within the scope of the present technology.

What is claimed as being new and desired to be protected by Letters Patent of the United States is as follows:

1. A pulsation valve system comprising:

a mandrel operably coupled to a rotor of a pulsation assembly, the mandrel comprising a mandrel bore defined through a first mandrel end and along a longitudinal axis of the mandrel, and one or more bypass bores defined through the mandrel and in communication with the mandrel bore;

an oscillating valve head attachable to the mandrel and rotatable with the mandrel, the oscillating valve head including an oscillating valve bore defined therethrough and parallel with a longitudinal axis of the oscillating valve head; and a stationary valve head positioned adjacent and stationary with respect to the oscillating valve head, the stationary valve head including a stationary valve bore defined therethrough and parallel with a longitudinal axis of the stationary valve head;

a spring located in the mandrel bore;

a piston slidably received in the mandrel bore in operable contact with the spring;

wherein the oscillating valve bore being alignable with the stationary valve bore at a predetermined rotational position;

wherein the mandrel bore is in communication with a first oscillating valve central bore of the oscillating valve head;

wherein the piston being configured to block an entrance of the bypass bores from inside the mandrel bore at a first position and to allow fluid to flow into the bypass bores from inside the mandrel bore at a second position.

2. The pulsation valve system according to claim 1, wherein an amount of fluid entering the stationary valve bore is dependent on a rotational location of the oscillating valve bore in relation with the stationary valve bore.

3. The pulsation valve system according to claim 2, wherein the stationary valve bore has a size greater than the oscillating valve bore.

4. The pulsation valve system according to claim 2, wherein the stationary valve bore has a radial length greater than a width of the oscillating valve bore.

5. The pulsation valve system according to claim 2, wherein the stationary valve bore is offset from a stationary valve central bore defined through the stationary valve head, and wherein the stationary valve bore is not in communication with the stationary valve central bore.

6. The pulsation valve system according to claim 5, wherein the stationary valve head is fixedly secured in a first end bore of a valve assembly housing, the first end bore of the valve assembly housing being configured to rotatably receive the oscillating valve head and at least a portion of the mandrel.

7. The pulsation valve system according to claim 6 further comprising a bushing located in the stationary valve central bore, the bushing being configured to rotatably and axially receive a valve end section of the mandrel.

8. The pulsation valve system according to claim 7, wherein the valve end section of the mandrel is receivable and secured in a second oscillating valve central bore defined in the oscillating valve head, the second oscillating valve central bore has a size greater than the first oscillating valve central bore defined in the oscillating valve head and is in communication therewith.

9. The pulsation valve system according to claim 7, wherein the oscillating valve head includes channels radially defined in an oscillating valve face of the oscillating valve head adjacent to a stationary valve face of the stationary valve head, and wherein the channels are configured to allow fluid to travel between the stationary valve head and the oscillating valve head to an open area between an internal area of the bushing and an external surface of the valve end section.

10. The pulsation valve system according to claim 1, wherein the spring is configured to allow the piston to move to the second position when a predetermined fluid pressure is provided on the piston from the mandrel bore received from the first oscillating valve central bore.

11. The pulsation valve system according to claim 1 further comprising a flexshaft connected to a second end of the mandrel, wherein the flexshaft is operably connecting to the rotor of the pulsation assembly.

12. A pulsation valve system comprising:

a mandrel operably coupled to a rotor of a pulsation assembly, the mandrel comprising a mandrel bore defined through a first mandrel end and along a longitudinal axis of the mandrel, and one or more bypass bores defined at an angle through the mandrel and in communication with the mandrel bore;

an oscillating valve head attachable to the mandrel and rotatable with the mandrel, the oscillating valve head including an oscillating valve bore defined therethrough and parallel with a longitudinal axis of the oscillating valve head; and a stationary valve head positioned adjacent and stationary with respect to the oscillating valve head, the stationary valve head including a stationary valve bore defined therethrough and parallel with a longitudinal axis of the stationary valve head, the stationary valve bore having a radial length greater than a width of the oscillating valve bore;

a spring located in the mandrel bore;

a piston slidably received in the mandrel bore in operable contact with the spring;

wherein the oscillating valve bore being alignable with the stationary valve bore at a predetermined rotational position;

wherein the mandrel bore is in communication with a first oscillating valve central bore of the oscillating valve head;

wherein the piston being configured to block an entrance of the bypass bores from inside the mandrel bore at a first position and to allow fluid to flow into the bypass bores from inside the mandrel bore at a second position based on a predetermined fluid pressure provided on the piston from the mandrel bore.

13. The pulsation valve system according to claim 12, wherein the stationary valve bore is offset from a stationary valve central bore defined through the stationary valve head, and wherein the stationary valve bore is not in communication with the stationary valve central bore.

14. The pulsation valve system according to claim 12, wherein the stationary valve head is fixedly secured in a first end bore of a valve assembly housing, the first end bore of the valve assembly housing being configured to rotatably received the oscillating valve head and at least a portion of the mandrel.

15. The pulsation valve system according to claim 14 further comprising a bushing located in a stationary valve central bore, the bushing being configured to rotatably and axially receive a valve end section of the mandrel.

16. The pulsation valve system according to claim 15, wherein the oscillating valve head includes channels radially defined in an oscillating valve face of the oscillating valve head adjacent to a stationary valve face of the stationary valve head, and wherein the channels are configured to allow fluid to travel between the stationary valve head and the oscillating valve head to an open area between an internal area of the bushing and an external surface of the valve end section.

* * * * *